US008393125B2

(12) United States Patent
Martel

(10) Patent No.: US 8,393,125 B2
(45) Date of Patent: Mar. 12, 2013

(54) HIDDEN FASTENER FOR DECK PLANKS WITH UNDERCUT SIDE GROOVES

(75) Inventor: David Martel, Harwinton, CT (US)

(73) Assignee: OMG, Inc., Agawam, MA (US)

( * ) Notice: Subject to any disclaimer, the term of this patent is extended or adjusted under 35 U.S.C. 154(b) by 52 days.

(21) Appl. No.: 13/030,625

(22) Filed: Feb. 18, 2011

(65) Prior Publication Data

US 2011/0197538 A1 Aug. 18, 2011

Related U.S. Application Data

(60) Provisional application No. 61/305,585, filed on Feb. 18, 2010.

(51) Int. Cl.
*E04B 2/30* (2006.01)

(52) U.S. Cl. ..... 52/489.1; 52/489.2

(58) Field of Classification Search ..... 52/715, 52/489.1, 489.2, 512, 586.1, 586.2, 650.3; 248/200; 411/461
See application file for complete search history.

(56) References Cited

U.S. PATENT DOCUMENTS

| | | | | |
|---|---|---|---|---|
| 3,589,660 | A * | 6/1971 | Dunckel | 248/343 |
| 5,642,597 | A * | 7/1997 | Hendrickson | 52/715 |
| 6,279,286 | B1 * | 8/2001 | Ichihashi | 52/489.1 |
| 6,497,395 | B1 * | 12/2002 | Croker | 248/300 |
| 6,536,179 | B2 * | 3/2003 | Little | 52/702 |
| 6,602,020 | B1 * | 8/2003 | Hansen | 403/395 |
| 6,871,467 | B2 * | 3/2005 | Hafner | 52/586.1 |
| 7,240,459 | B2 * | 7/2007 | Daudet et al. | 52/289 |
| D625,168 | S * | 10/2010 | Chen | D8/354 |
| 8,011,153 | B2 * | 9/2011 | Orchard | 52/489.1 |
| 8,100,619 | B2 * | 1/2012 | Curtis | 411/477 |
| 8,191,327 | B2 * | 6/2012 | Griffiths et al. | 52/506.08 |
| 2004/0020152 | A1 * | 2/2004 | Harris, Sr. | 52/582.1 |
| 2008/0282641 | A1 * | 11/2008 | Sackett | 52/715 |
| 2009/0166486 | A1 * | 7/2009 | Sugiyama et al. | 248/200 |

* cited by examiner

*Primary Examiner* — Brian Glessner
*Assistant Examiner* — Paolo Agudelo
(74) *Attorney, Agent, or Firm* — Alix, Yale & Ristas, LLP

(57) ABSTRACT

Deck planks with undercut side grooves can be attached to underlying joists by hidden fasteners with leading wings and trailing feet engaged into the side grooves of the deck planks. The bodies of the hidden fasteners space the deck planks so as to provide adequate drainage gaps between the top faces of the deck planks. A power driver tool can be used for rapidly positioning the hidden fasteners and for attaching the hidden fasteners to the joists.

15 Claims, 6 Drawing Sheets

HIDDEN FASTENER FOR DECK PLANKS WITH UNDERCUT SIDE GROOVES

CROSS REFERENCE TO RELATED APPLICATIONS

The present application is a non-provisional of U.S. Provisional Patent Application Ser. No. 61/305,585, "HIDDEN FASTENER FOR DECK PLANKS WITH UNDERCUT SIDE GROOVES", filed Feb. 18, 2010, and hereby incorporates herein by reference the disclosures thereof. The present application also hereby incorporates herein by reference all relevant disclosures of co-pending and commonly owned U.S. patent application Ser. Nos. 11/717,395, "FASTENER FOR GROOVED OR SLOTTED DECKING MEMBERS", filed Mar. 13, 2007, and 12/573,540, "APPARATUS AND METHOD FOR RAPID INSTALLATION OF HIDDEN DECK PLANK FASTENERS", filed Oct. 5, 2009.

FIELD OF THE INVENTION

The invention relates to deck plank fasteners for securing a deck plank to a joist and for supporting deck planks relative to one another. More particularly, the invention relates to a hidden deck plank fastener that is not visible and does not protrude from the deck surface when installed to secure a deck plank with undercut side grooves.

BACKGROUND OF THE INVENTION

One simple deck plank fastening system consists of a plurality of securing or anchoring members, such as nails or screws, driven downward through the top of a plank, such as a wood or composite board, and into the top surface of a supporting beam, such as a joist or ledger board. Although the concept is simple, professional quality installation using this approach requires a high degree of precision, significant time expenditure, and sometimes leads to a flawed result.

Deck planks installed using the simple system of the preceding paragraph must be carefully aligned to achieve a desirable aesthetic as well as functional result, for example, secure attachment and uniform spacing or parallelism without large gaps. Also, the insertion of the nails or screws must be performed carefully to ensure proper penetration of the joist, which will be concealed from view by the overlying wood board at the time of insertion, in order to achieve optimal attachment. Thus, although the system itself is simple, methods for making and using the system are not.

Even if the above-described simple system is properly installed, penetration of each deck plank by several securing members leaves each plank with a pock-marked appearance and prone to rot and weather damage, which severely decreases the longevity of the deck. In addition, each nail or screw may work loose and protrude from the upper surface of the planks, presenting a risk of injury to users of the deck. In summary, the simple conventional system of deck plank installation, using fasteners driven through each plank, detracts from the integrity of each plank and of the deck as a whole, and presents a risk of injury to users.

These and other problems have spurred on numerous advancements in the field. For instance, an improved deck plank fastening system includes fasteners that attach to a side surface of the plank and a top surface of the joist using nails or screws. Such designs facilitate uniform spacing or parallelism of planks by providing tabs or vertically oriented flanges that engage adjacent planks. The tabs facilitate installation by locating the points of penetration at more readily visible and accessible positions. The fasteners improve the longevity of the resulting deck by repositioning the point of penetration to the side of the plank, which is less prone to weathering. In addition, the tabs reduce the risk of injury to the user of the deck by hiding the nails or screws below the surface. Also, the hidden fasteners improve the aesthetic appeal of the deck.

Many other improvements and permutations have been conceived in this field, including the provision of deck planks with side grooves for receiving the teeth or tabs of hidden fasteners. Such improvements have specific advantages in specific circumstances, but have not foreclosed innovation in the field. For example, it has been proposed to provide deck planks with undercut side grooves so as to mitigate a possible problem of moisture collection in the side grooves. However, it is considered that known hidden fasteners are not compatible to planks with undercut side grooves.

SUMMARY OF THE INVENTION

According to some embodiments of the invention, a fastener is provided for hidden attachment of a deck plank to a joist. The inventive fastener includes a generally flat body that extends from a left end to a right end between leading and trailing edges. An attachment hole is formed through the body of the fastener. From the leading edge of the body, an arm extends upward. The arm includes a wing that extends away from the body. The arm also includes at least one alignment hole formed at a position substantially in registry with the position of the attachment hole along the body. A trailing leg extends upward from the trailing edge of the body. The leg includes at least one foot that extends away from the body, and also includes a notch indented toward the body substantially in registry with the position of the attachment hole along the body.

According to some embodiments of the invention, a weather shedding deck structure includes a joist, a deck plank, a fastener, and an elongated securing member. The joist has an upper edge surface to which the deck plank is attached. The deck plank has a top face and a bottom face extending between first and second ends. The top and bottom face of the deck plank are joined by first and second grooved sides. Each grooved side of the deck plank includes upper and lower nubs that are separated by a side groove. The upper nubs of the deck plank define a width of the top face and the lower nubs define a width of the bottom face that is less than the width of the top face. The deck plank is installed on the joist with its bottom face on the upper edge face of the joist. The fastener has a generally flat body that extends from a left end to a right end between leading and trailing edges, and that has an attachment hole formed through the body. The flat body of the fastener rests on the upper edge face of the joist. From the leading edge of the fastener body, a leading arm extends upward to a leading wing that extends away from the body. The leading wing is engaged into a side groove of the deck plank. The fastener also includes a trailing leg that extends upward from the trailing edge of the body to a trailing foot, which extends away from the body opposite the leading wing. The trailing leg includes a notch indented toward the body substantially in registry with the position of the attachment hole along the body. The elongated securing member is driven through the attachment hole of the fastener and into the joist.

In some aspects of the invention, a weather shedding deck may be rapidly made by repeatedly using a power driver tool to position a fastener in engagement with a groove formed in a plank positioned on a joist, while also using the power driver tool to drive an elongated securing member through the fastener and into the joist.

Thus, among other benefits, the invention provides an improved hidden deck plank fastener, which, among other desirable attributes, significantly reduces or overcomes the above-mentioned deficiencies of prior deck plank fasteners.

These and other objects, features and advantages of the present invention will become apparent in light of the detailed description of the best mode embodiment thereof, as illustrated in the accompanying drawings.

As used herein, "generally", "substantially", and "about" are meant to include structures or conditions that approximate an ideal desired structure or condition within reasonably achievable manufacturing and assembly tolerances, suitable for achieving the functional purpose of a component or assembly. By way of an example, a "generally" flat surface may nonetheless include small, microscopic, or perceptible roughnesses, prominences, or indentations, as well as intentional protrusions or declivities, so long as those non-flat features do not interfere with the intended purpose of the generally flat surface. Similarly, as another example, an assembly of components in "substantial" alignment to a common axis of rotation may deviate from perfectly co-axial alignment so long as all the components can rotate as intended for accomplishing the functional purpose of the assembly. The term "appreciable" is meant to indicate features or qualities that can be measured or observed by those of ordinary skill in practice of the invention, while "significant" is meant to indicate a variation of a feature or quality that measurably affects performance of a related function.

DESCRIPTION OF PREFERRED EMBODIMENTS

Figure 1:
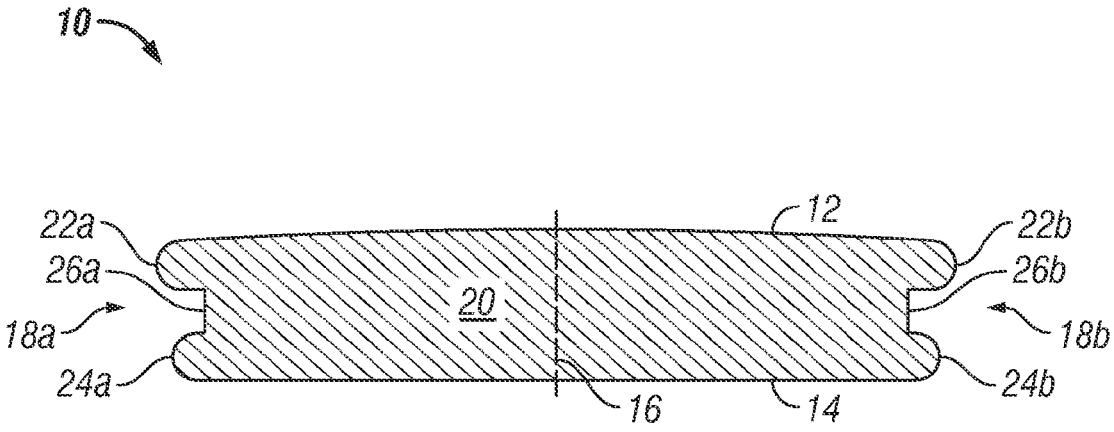
FIG. 1 shows a sectioned end view of an exemplary deck plank with an undercut side groove.

FIG. 1 shows a grooved deck plank 10 that has a convex top face 12, a bottom face 14, a vertical mid-plane 16, and two grooved sides 18*a*, 18*b* defining a profile 20 that is symmetric across the vertical mid-plane. Each grooved side has an upper nub 22, a lower nub 24, and a side groove 26 indented into the grooved side toward the mid-plane between the upper nub and the lower nub. The upper nub of each grooved side protrudes to a first distance from the vertical mid-plane, defining a half-width of the deck plank top face. The lower nub of each grooved side protrudes to a second distance from the vertical mid-plane, less than the first distance, defining a half-width of the deck plank bottom face. Thus, the deck plank bottom face is narrower than the deck plank top face. It is believed that the resulting profile reduces accumulation of moisture in the side grooves 26. Although the horizontal offset of the lower nub from the upper nub may vary according to commercial specifications, a vertical angle measured across the upper and lower nubs typically may be between about five (5) and about twenty five (25) degrees.

Figure 2:
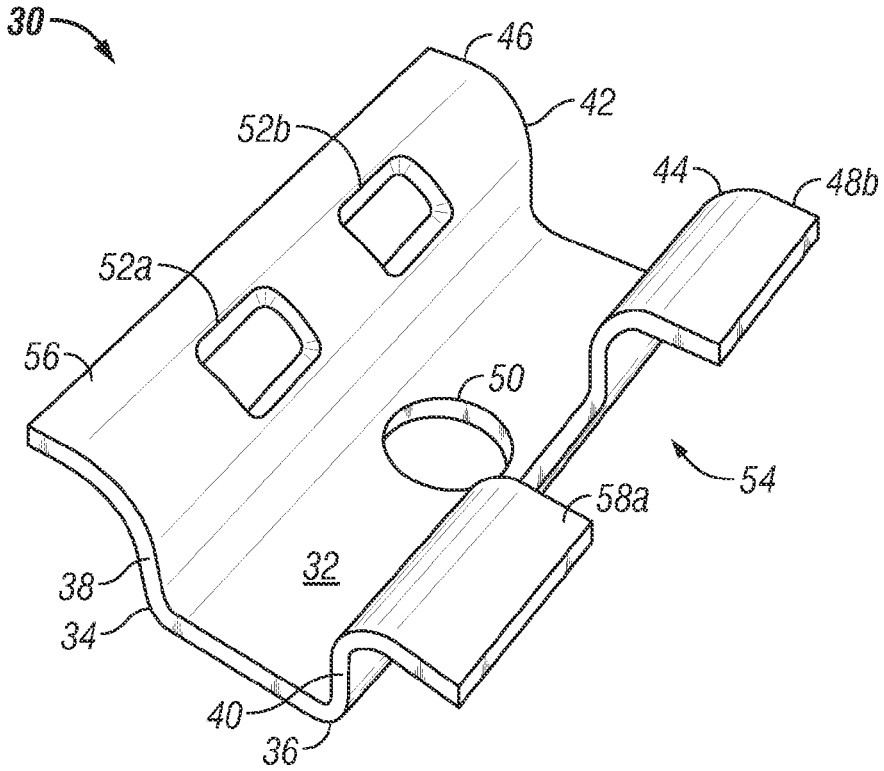
FIG. 2 shows a perspective view of a hidden fastener for use with deck planks such as the plank shown in FIG. 1, according to an embodiment of the present invention.
Figure 3:
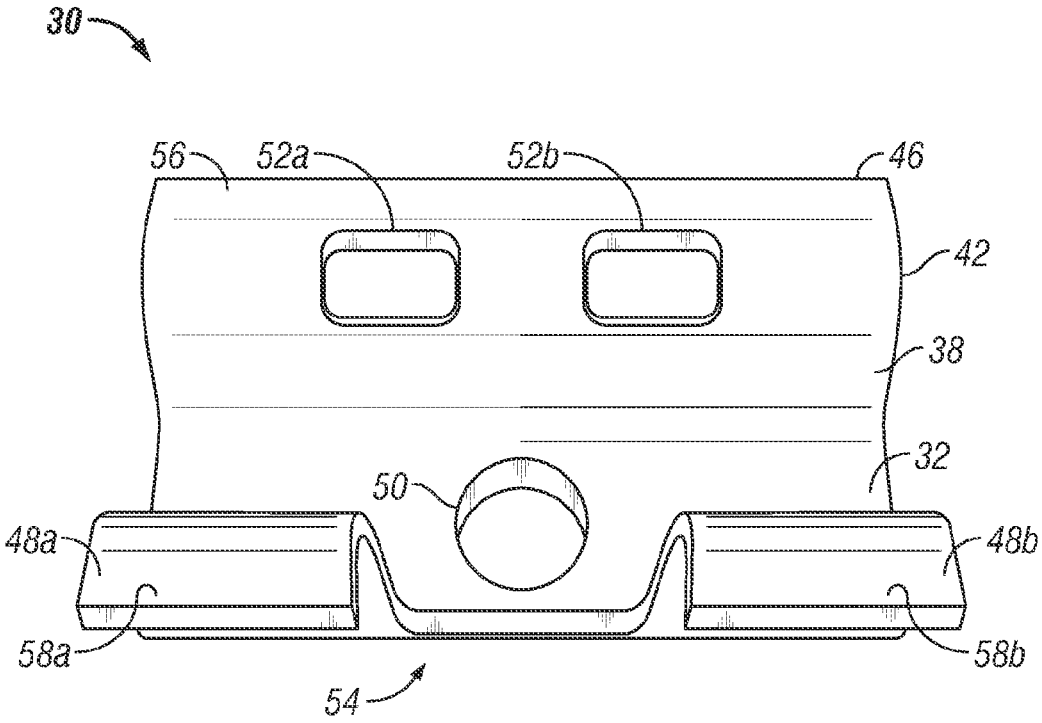
FIG. 3 shows another perspective view of the hidden fastener shown in FIG. 2.
Figure 4:
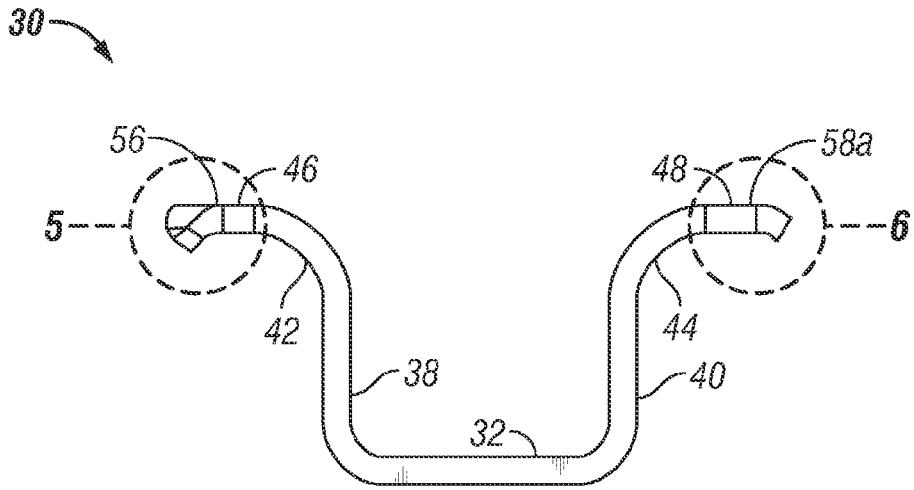
FIG. 4 shows an end view of the hidden fastener shown in FIGS. 2-3.
Figure 5:
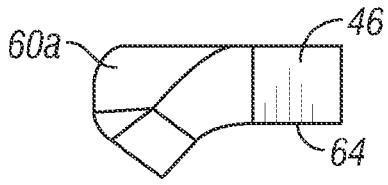
FIGS. 5 and 6 show details of FIG. 4.
Figure 6:
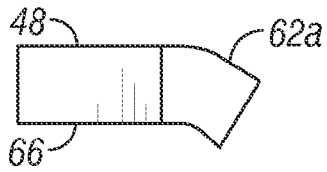
Figure 7:
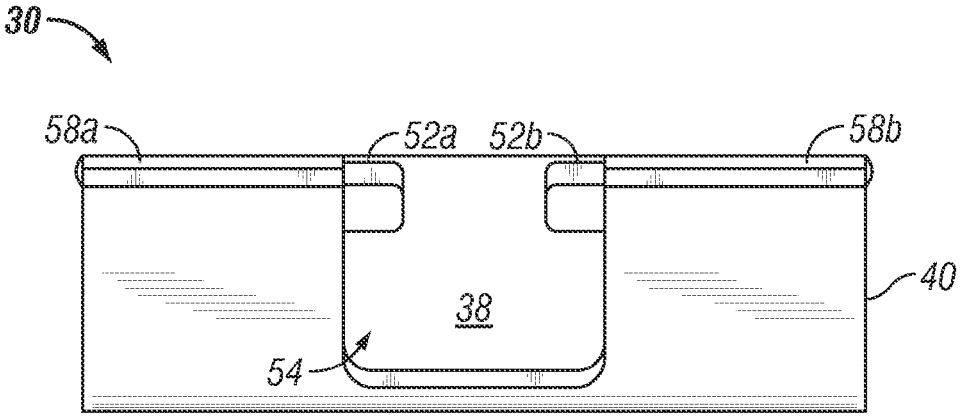
FIG. 7 shows a side view of the hidden fastener shown in FIGS. 2-6.

According to an embodiment of the present invention, FIGS. 2 and 3 show a hidden deck plank fastener 30, which has a generally flat horizontal body 32 with leading and trailing edges 34, 36 extending from a left end to a right end. At the leading edge of the horizontal body, the hidden fastener is bent to form an upwardly extending leading arm 38. At the trailing edge of the horizontal body, the hidden fastener is bent to form an upwardly extending trailing leg 40. The leading arm and the trailing leg are spaced apart in parallel fashion by the horizontal body of the fastener.

The leading arm 38 is bent, at an upper bend 42 extending parallel to the body of the fastener, to form a leading wing 46 extending substantially parallel to and away from the horizontal body. The trailing leg 40 is bent at an upper bend 44 to form at least one trailing foot 48 extending substantially parallel to and away from the body. The leading wing and the trailing foot, in the embodiment shown in FIGS. 2 and 3, are substantially coplanar.

The hidden fastener 30 also includes an attachment hole 50 formed through the horizontal body for receiving an elongated securing member for securing the hidden fastener to a joist, as further discussed below with reference to FIG. 8. The leading upper bend 42 has alignment holes 52*a*, 52*b* formed therethrough, bracketing the position of the attachment hole, for engagement of the hidden fastener onto a pneumatic nail driver or other power driver tool. Additionally, the trailing leg and feet include a notch 54, formed in registry with the position of the attachment hole, which separates the trailing foot 48 into left and right portions 48*a*, 48*b*. In some embodiments, the notch 54 permits access to the attachment hole by a power driver tool. In select embodiments, the alignment holes and the notch are disposed so as to engage the hidden fastener onto a power driver tool such that a securing member driven by the power driver tool will pass through the attachment hole at an angle of between about thirty (50) and about fifty (50) degrees from the plane of the leading arm 38.

Referring to FIGS. 4 through 7, the leading wing 44 is indented across its width by a first bend score 56, and the trailing foot 48 is indented with a second bend score 58. From the first bend score 56, left and right corners of the leading wing are bent downward to form claws 60*a*, 60*b* for engagement with the lower nub 24 of the deck plank shown in FIG. 1. The claws 60*a*, 60*b* preferably are bent downward to angles of about one hundred thirty five (135) degrees from a lower surface 64 of the leading wing 46. From the second bend score 58, left and right portions of the trailing foot 48 are bent downward to form toes 62*a*, 62*b* for engagement with the lower nub of a second deck plank similar to the deck plank shown in FIG. 1. The toes 62*a*, 62*b* preferably are bent downward to angles of about one hundred fifty (150) degrees from a lower surface 66 of the trailing foot 48. These bend angles are believed to be optimal for securely engaging deck planks with undercut side grooves, such as the plank 10 shown in FIG. 1, without damaging lower nubs 24 of the deck planks. However, a range of suitable angles for the toes and claws may be determined based on properties of particular deck planks with which the hidden fastener 30 will be utilized. For example, surface hardness and grain strength of the deck planks may be key properties for determining suitable angles.

Figure 8:
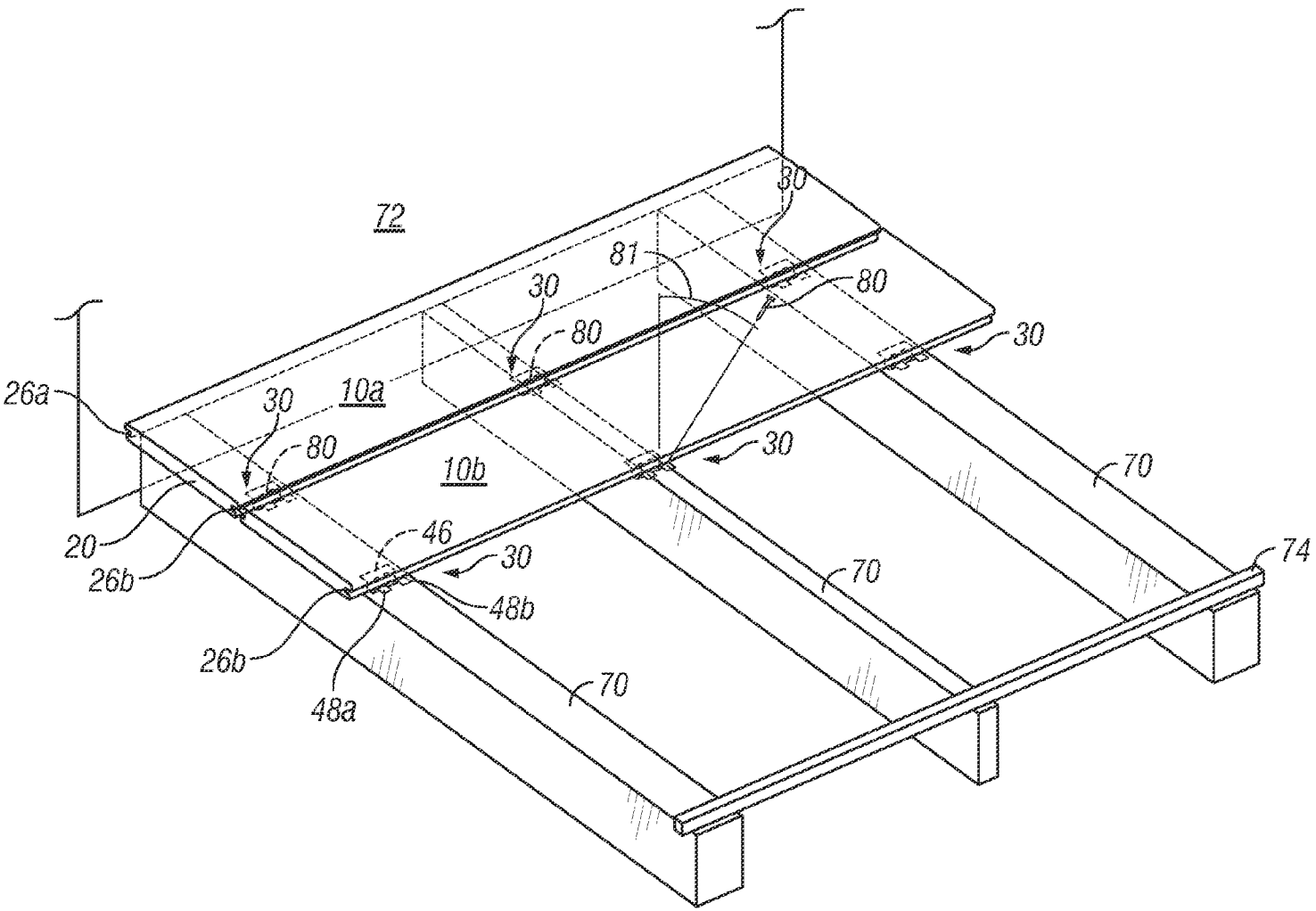
FIG. 8 shows a perspective view of deck planks assembled to joists using a plurality of hidden fasteners, according to an embodiment of the present invention.

Referring to FIG. 8, a plurality of hidden fasteners 30 can be used with a corresponding plurality of elongated securing members 80 for fastening a sequence of planks 10, as shown in FIG. 1, onto the upper edges faces 70 of a planar array of joists, which may be fixed by conventional brackets, toe-nails, or other means to a backstop 72 (such as a wall or a plane defined by an array of posts). In use, a lead plank 10*a* is positioned onto the upper edge faces of the joists with one of its grooved sides 18*a* positioned against the backstop and with the other grooved side 18*b* "open" toward the free ends of the joists. A first group of hidden fasteners then are assembled to the lead plank with their leading wings 46 inserted into the open side groove 26*b*, and each hidden fastener is attached to one of the joists 70 by an elongated securing member 80, one fastener per joist. In some embodiments, the attachment hole 50 is dimensioned such that each elongated securing member forms a substantially water tight joint with each fastener body 32, thereby providing for water to be shed from the upper edge face of each joist even at the locations where the elongated securing members penetrate the joists. In select embodiments, weather shedding qualities and durability of the hidden fastener and of the elongated securing member may be enhanced by selecting, for fabrication of the hidden fastener and of the elongated securing member, materials that are chemically and galvanically compatible. For example, the hidden fastener may be formed from mild steel, while in select embodiments the elongated securing member may also be formed from mild steel, or from another metal that is compatible with the hidden fastener (without appreciable mutual galvanic corrosion when in contact in an outdoor environment). In further embodiments, the materials of the hidden fastener and of the elongated securing member also may be selected for compatibility with the deck planks.

In some aspects of the invention, each of the hidden fasteners 30 in turn is held by a pneumatic nail driver or other power driver tool (not shown), is engaged with the lead plank 10*a*, and concurrently is attached to one of the joist edge faces 70 by an elongated securing member driven from the power driver tool, substantially as disclosed in co-pending U.S. patent application Ser. No. 12/573,540. In some embodiments, engagement of the hidden fastener into the side groove 26*b* and over the offset lower nub 24*b*, may be enhanced by driving each elongated securing member 80 into the joist from the power driver tool at an angle 81 of between about twenty five (25) and about fifty (50) degrees measured in a vertical plane aligned with the joist. In some embodiments, each elongated securing member is driven at an angle of between about thirty (30) and about forty five (45) degrees.

Subsequent to attachment of the lead plank 10*a* onto the joist upper edge faces 70, a first trail plank 10*b* then is assembled onto the trailing foot portions 48*a*, 48*b* of the first group of hidden fasteners. The trailing foot toes 62*a*, 62*b* flex so that trail planks may be assembled and removed to and from the hidden fasteners, without appreciable dislodgement of the hidden fasteners or significant damage to the trail plank lower nubs. A second group of hidden fasteners then are assembled to the first trail plank and attached to the several joists, substantially as for the first group of hidden fasteners. The leading arm and the trailing leg positively position the lower nubs of such planks so that the upper nubs and top faces of the planks are separated by appropriate drainage gaps. At the free ends of the joists, a cap rail 74 can be provided to cover the trailing feet of a final group of hidden fasteners.

Figure 9:
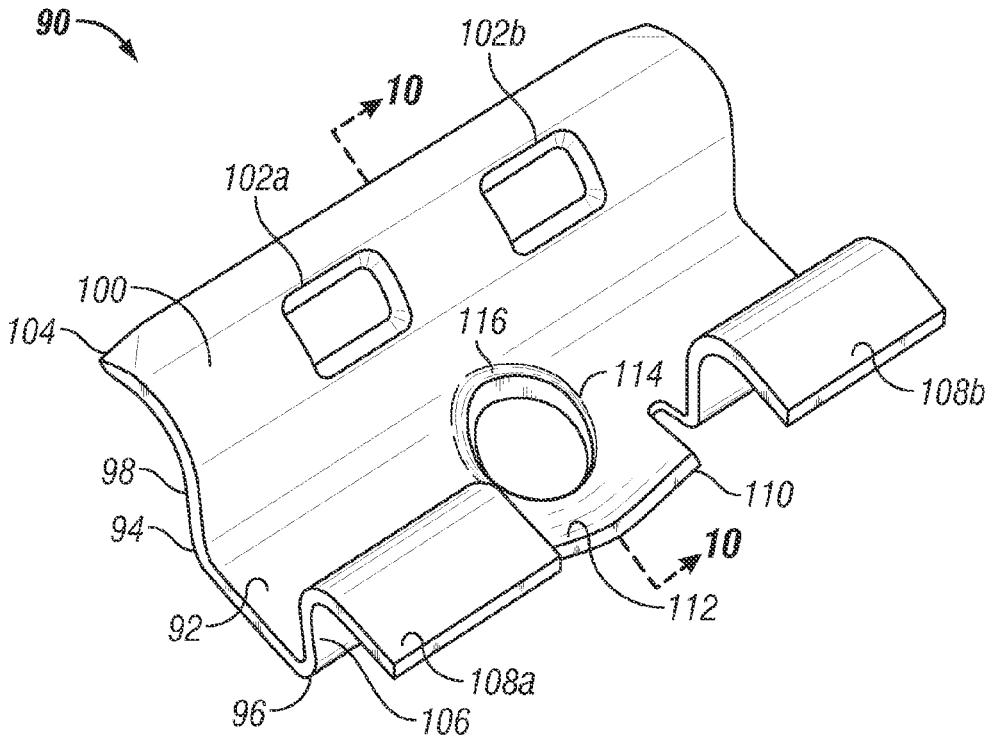
FIG. 9 shows a perspective view of another hidden fastener for use with deck planks such as the plank shown in FIG. 1, according to another embodiment of the present invention.
Figure 10:
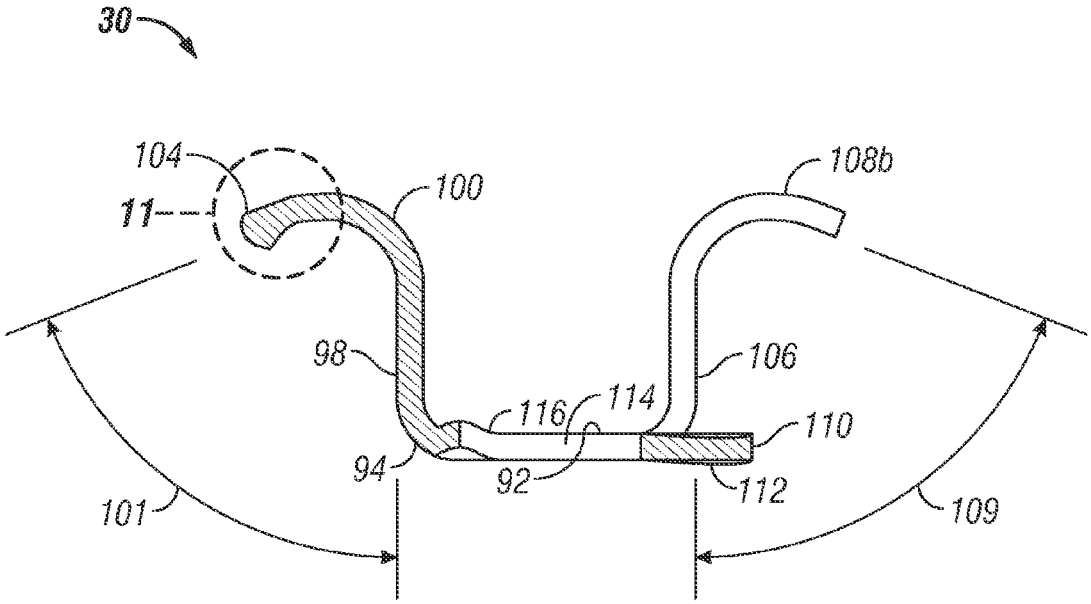
FIG. 10 shows the same hidden fastener, sectioned at view line 10-10 shown in FIG. 9.
Figure 11:
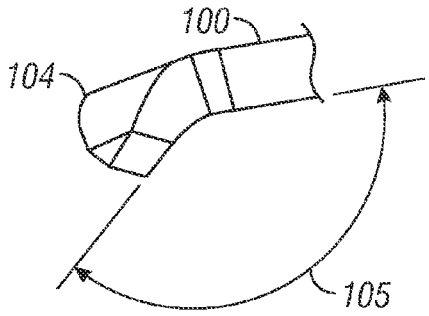
FIG. 11 shows a detail of FIG. 10.

According to another embodiment of the invention, as shown in FIGS. 9-11, a hidden fastener 90 includes a body 92, extending from left to right ends between a leading edge 94 and a trailing edge 96. From the leading edge 94, the body is bent upward to define a leading arm 98. At an upper bend the leading arm continues to a leading wing 100. Referring specifically to FIG. 10, a distal portion of the leading wing is bent to define an angle 101 with reference to the leading arm 98. In some embodiments, the angle 101 may be between about seventy (70) to about ninety five (95) degrees. In select embodiments, the angle 101 may be between about seventy five (75) to about eighty five (85) degrees. In a specific embodiment, the angle 101 is about seventy eight (77.6) degrees. The angle of the leading wing should be selected according to material of the hidden fastener 90 and according to dimensions and properties of the planks with which the hidden fastener is to be used. For example, a harder plank may require a shallower angle for proper installation of the hidden fastener.

Referring back to FIG. 9, the bent portion of the leading wing 100 includes two alignment holes 102*a*, 102*b*. Corners of the leading wing also include downwardly-bent claws 104, as further discussed below with reference to FIG. 11. Still referring to FIG. 9, at a location along the fastener body 92, substantially in registry between the alignment holes, an attachment hole 114 is formed through the fastener body. In some embodiments, the attachment hole may be formed at an angle from the leading arm 98. In other embodiments, the attachment hole may be formed generally perpendicularly through the fastener body.

Across from the leading arm 98, the fastener body 92 is bent upward at its trailing edge 96 to form a trailing leg 106. The trailing leg 106 is split, substantially in line with the attachment hole 114 formed through the fastener body, to form two trailing feet 108*a*, 108*b* and a trailing tab 110. The trailing feet can be engaged into a side groove of a trailing deck plank to be assembled onto the hidden fastener 90, while the trailing tab may stabilize the hidden fastener against rocking motion during installation on an upper edge surface of a joist. Additionally, the trailing tab 110 provides additional surface area for engagement with the fastener body 92 of an elongated surface member driven at an angle through the attachment hole 114.

As shown in FIG. 10, the trailing feet are curved rearward and downward to define angles 109 with reference to the trailing leg. In some embodiments, the angle 109 may be between about seventy five (75) to about eighty five (85) degrees. In a specific embodiment, each angle 109 is about eighty (80.0) degrees. As for the angle 101 defined by the leading wing 100, the angle 109 should be selected according to dimensions and material properties of the hidden fastener 90 and of the range of planks with which the fastener is to be used. Generally, the angles 101 and 109 permit the hidden fastener 90 to securely engage lower nubs of a variety of side grooved deck planks, which may have either undercut or level-edged profiles with grooves located at varying heights.

Referring to both FIGS. 9 and 10, the trailing tab 110 is deformed downward from the fastener body 92 by an upwardly concave dent or tool strike 112, disposed generally in line with the attachment hole 114. Opposite the trailing tab and directly across the attachment hole from the dent, the fastener body 92 is itself deformed upward by an upwardly convex divot or second tool strike 116. The dent and the divot are disposed such that a plane tangent to both would be angled with reference to the fastener body. For example, such a plane might be angled by between about twenty five (25) to about fifty (50) degrees from the body of the hidden fastener 90.

In use of the hidden fastener 90, the dent may enhance engagement of the hidden fastener 90 with an upper edge surface of a joist on which the fastener is installed. Additionally, the dent and the divot may aid in properly positioning the hidden fastener 90 onto a power driver tool, such that the power drive tool may drive an elongated securing member through the attachment hole 114 and into a joist at an angle of between about twenty five (25) to about fifty (50) degrees while the leading wing 100 is engaged into a side groove of a deck plank. Moreover, the divot may enhance rigidity of the fastener body 92 for receiving, substantially without distortion, an impact from an elongated securing member driven through the attachment hole.

Referring also to FIG. 11, the dent 112 and the divot 116 may enhance engagement of the claws 104 against a lower nub of a deck plank with which the leading wing 100 is engaged. More particularly, the dent may act as a fulcrum, such that driving a securing member through the attachment hole 114, with the head of the securing member striking the divot, may exert substantial downward leverage on the claws 104. In some embodiments, the claws 104 define an angle 105 with reference to the leading wing. In select embodiments, the angle defined by the claws may be between about one hundred thirty (130) and one hundred forty (140) degrees. In a specific embodiment, the angle 105 is about one hundred thirty five (135) degrees.

Although it is contemplated that the embodiments specifically shown and disclosed herein may be formed from sheet metal, one of ordinary skill will appreciate that other materials and modes of manufacture equally may be utilized for producing substantially similar embodiments. By way of example, and without intent to limit the scope of the appended claims, casting, metal injection molding, sintering, polymer injection molding, forging, or milling of metal or of high-strength polymer, all might be acceptable substitutes for sheet metal forming, presuming that appropriate modifications to dimensions could feasibly be made. Further, although only exemplary embodiments have been shown and disclosed, it will be understood that appreciable or significant changes may be made to specific shapes or dimensions without thereby substantially departing from the overall concept and functional effects of the invention.

Thus, although this invention has been shown and described with respect to the detailed embodiments thereof, it will be understood by those skilled in the art that various changes in form and detail thereof may be made without departing from the spirit and the scope of the invention as defined by the claims appended hereto.

What is claimed is:

1. A fastener comprising:

a generally flat body extending from a left end to a right end between leading and trailing edges, and including an attachment hole formed therethrough;

a leading arm extending upward from the leading edge of said body and including a leading wing that extends away from said body, the leading arm including at least one alignment hole formed at a position substantially in registry with the position of the attachment hole along said body; and a trailing leg extending upward from the trailing edge of said body and including at least one trailing foot that extends away from said body, the trailing leg including a notch indented toward said body substantially in registry with the position of the attachment hole along said body, wherein leading corners of the leading wing are bent downward to form angled claws with respect to the leading wing.

2. A fastener as claimed in claim 1, wherein said body includes an upwardly convex divot formed adjacent the leading edge and substantially in registry with the position of the attachment hole along said body.

3. A fastener as claimed in claim 1, further comprising a trailing tab extending from the trailing edge of said body substantially continuous and generally coplanar with said body and substantially in registry with the notch formed in said trailing leg.

4. A fastener as claimed in claim 3, wherein said trailing tab includes a upwardly concave dent disposed substantially in registry with the position of the attachment hole along said body.

5. A fastener as claimed in claim 4, wherein said body includes an upwardly convex divot formed adjacent the leading edge and substantially in registry with the position of the attachment hole along said body, and a plane tangent to the divot and to the dent defines an angle of between about 25 and about 50 degrees relative to said body.

6. A fastener as claimed in claim 5, wherein the attachment hole is formed through said body at an angle of between about 25 and about 50 degrees relative to a plane through the leading edge perpendicular to said body.

7. A fastener as claimed in claim 1, wherein the leading wing is bent to define an angle of between about 70 to about 95 degrees with respect to the leading arm.

8. A fastener as claimed in claim 1, wherein the leading wing is bent to define an angle of between about 75 to about 85 degrees with respect to the leading arm.

9. A fastener as claimed in claim 1, wherein the claws are bent at angles of between about 120 to about 140 degrees with respect to the leading wing.

10. A fastener as claimed in claim 1, wherein the trailing feet are bent to define angles of between about 75 to about 85 degrees with respect to the trailing leg.

11. A fastener as claimed in claim 1, consisting essentially of mild steel.

12. A fastener comprising:

a generally flat body extending from a left end to a right end between leading and trailing edges, and including an attachment hole formed therethrough;

a leading arm extending upward from the leading edge of said body and including a leading wing that extends away from said body, the leading arm including at least one alignment hole formed at a position substantially in registry with the position of the attachment hole along said body;

a trailing leg extending upward from the trailing edge of said body and including at least one trailing foot that extends away from said body, the trailing leg including a notch indented toward said body substantially in registry with the position of the attachment hole along said body; and a trailing tab extending from the trailing edge of said body substantially continuous and generally coplanar with said body and substantially in registry with the notch formed in said trailing leg, the trailing tab including an upwardly concave dent disposed substantially in registry with the position of the attachment hole along said body.

13. The fastener of claim 12, wherein the leading wing is bent to define an angle of between about 70 to about 95 degrees with respect to the leading arm.

14. The fastener of claim 12, wherein the attachment hole is formed through said body at an angle of between about 25 and about 50 degrees relative to a plane through the leading edge perpendicular to said body.

15. The fastener of claim 12, wherein the trailing feet are bent to define angles of between about 75 to about 85 degrees with respect to the trailing leg.

* * * * *